US008261843B2

(12) United States Patent
Daspit et al.

(10) Patent No.: US 8,261,843 B2
(45) Date of Patent: Sep. 11, 2012

(54) PORTABLE WALL-ATTACHABLE FIRE FIGHTING APPARATUS AND METHOD

(75) Inventors: Douglas A. Daspit, Mauriceville, TX (US); Dwight P. Williams, Vidor, TX (US)

(73) Assignee: WillFire HC, LLC, Mansfield, TX (US)

( * ) Notice: Subject to any disclaimer, the term of this patent is extended or adjusted under 35 U.S.C. 154(b) by 1387 days.

(21) Appl. No.: 09/569,178

(22) Filed: May 11, 2000

(65) Prior Publication Data

US 2009/0242216 A1 Oct. 1, 2009

Related U.S. Application Data

(63) Continuation-in-part of application No. PCT/US98/21720, filed on Oct. 14, 1998.

(51) Int. Cl.
*A62C 2/00* (2006.01)

(52) U.S. Cl. ..... 169/43; 169/66

(58) Field of Classification Search ..... 169/24, 169/25, 43, 51, 52, 70, 47; 239/587.1, 587.4, 239/587.5, 569, 578, 579, 451
See application file for complete search history.

(56) References Cited

U.S. PATENT DOCUMENTS

| | | | | | |
|---|---|---|---|---|---|
| 1,956,083 | A | | 12/1931 | Steinicke et al. | |
| 1,955,265 | A | | 4/1934 | Warnock | |
| 2,725,943 | A | | 12/1955 | Grossheim | |
| 3,846,515 | A | * | 11/1974 | Williamson | 169/15 |
| 3,863,844 | A | * | 2/1975 | McMillan | 239/452 |
| 3,866,687 | A | * | 2/1975 | Banner | 169/26 |
| 3,884,307 | A | * | 5/1975 | Williams | 169/59 |
| 3,893,624 | A | * | 7/1975 | Thompson | 239/107 |
| 4,037,664 | A | * | 7/1977 | Gibson | 169/15 |
| 4,392,618 | A | * | 7/1983 | Evans et al. | 239/461 |
| 4,506,738 | A | * | 3/1985 | Evans et al. | 169/24 |
| 4,674,686 | A | * | 6/1987 | Trapp | 169/24 |
| 4,781,252 | A | | 11/1988 | Wilburn et al. | |
| 4,793,557 | A | * | 12/1988 | Marchese et al. | 169/24 |
| 4,979,571 | A | * | 12/1990 | MacDonald | 169/44 |
| 5,117,916 | A | * | 6/1992 | Ohta et al. | 169/37 |
| 5,488,995 | A | * | 2/1996 | Kuwahara | 169/24 |
| 5,857,526 | A | * | 1/1999 | Manges | 169/52 |
| 5,913,366 | A | * | 6/1999 | Williams et al. | 169/46 |
| 6,035,940 | A | * | 3/2000 | Bourke | 169/47 |

OTHER PUBLICATIONS

Installation of Sprinkler Systems, NFPA 13, 1999 edition, section 3-1.2, p. 13-15.*

* cited by examiner

*Primary Examiner* — Davis Hwu
(74) *Attorney, Agent, or Firm* — Sue Z. Shaper

(57) ABSTRACT

Portable wall-attachable firefighting monitor apparatus and method of use, including structure designed in combination to affix a monitor to a wall rim portion.

24 Claims, 6 Drawing Sheets

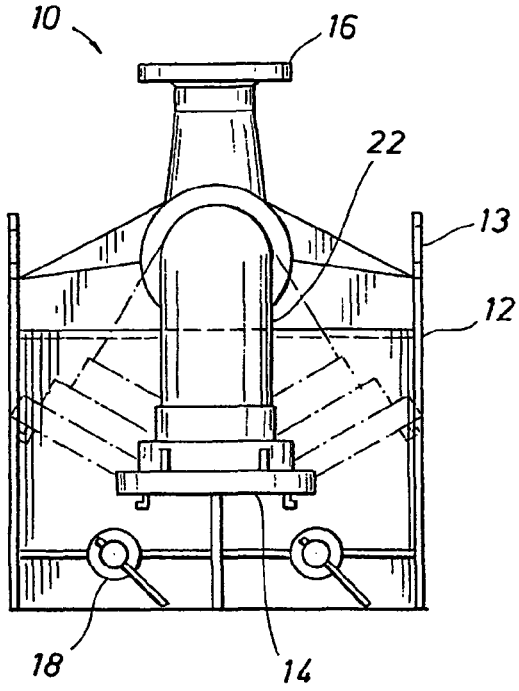
FIG. 2A
FIG. 2B
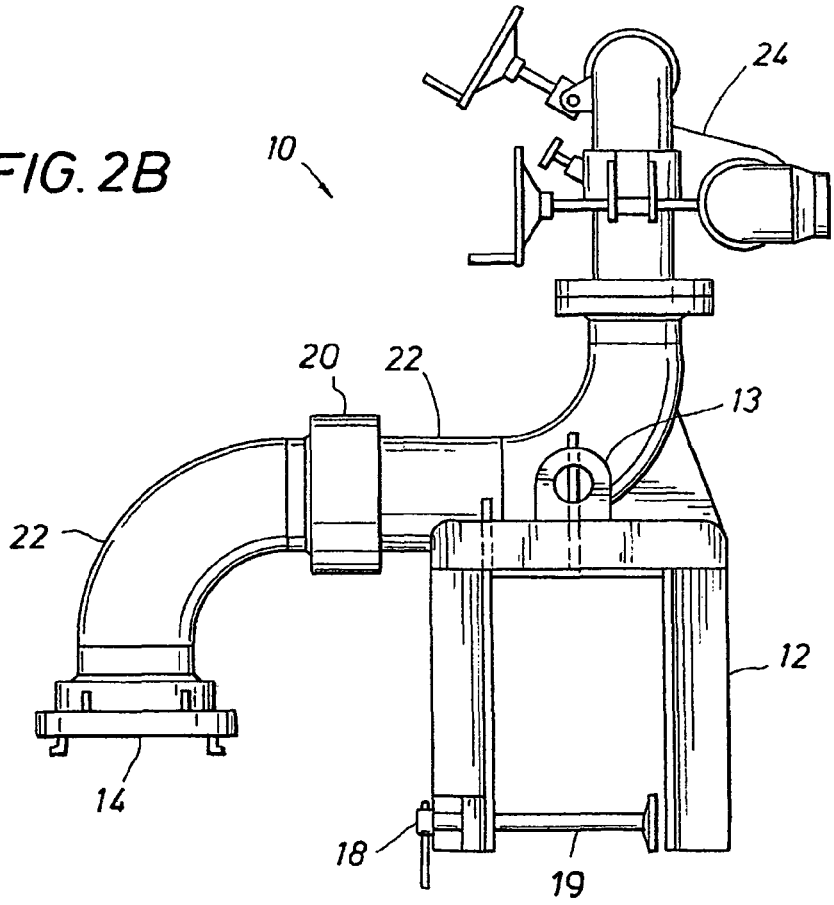

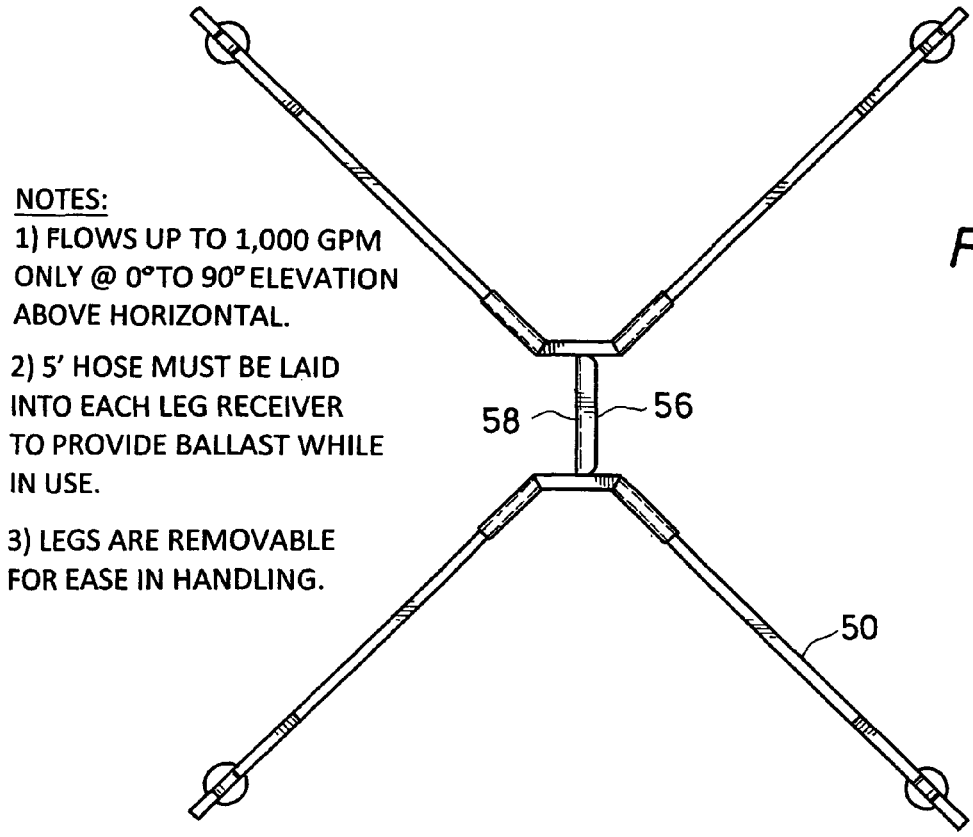
FIG. 7B
FIG. 7A
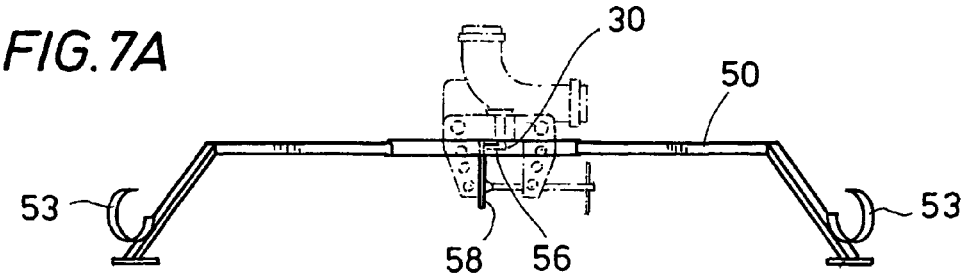

PORTABLE WALL-ATTACHABLE FIRE FIGHTING APPARATUS AND METHOD

This application is a continuation-in-part of application Serial No: PCT/US98/21720, filed Oct. 14, 1998.

FIELD OF INVENTION

The instant invention pertains to fire fighting apparatus and methods and more particularly to portable wall-attachable monitor apparatus and methods of use, particularly applicable to fighting tank seal fires and for inhibiting vapor release from tanks having sunken or dislodged roofs and for blanketing roof seal tank fires with foam.

BACKGROUND OF INVENTION

Industrial fires and tank fires are typically fought utilizing portable nozzles staged a distance from the fire. Such uses of nozzles may be referred to as Type III applications. Portable nozzles stationed a distance away from the tank, however, lose some percent of the fire fighting fluid to "fallout" as the fluid transits the distance from the nozzle to the tank surface. Fallout is particularly noticeable and regrettable when throwing foam, an expensive fluid.

A more precise and efficient method of fighting at least certain fires and hazardous vapor situations can be achieved by stationing a nozzle on a wall rim, as for instance the rim of a tank during a hazardous emergency. The instant invention discloses methods and apparatus for stationing a monitor on a tank wall, or the like, in order to blanket a fire with fluid such as foam, to suppress vapors and/or to extinguish flammable liquid fire.

In preferred embodiments a portable wall-attachable monitor apparatus includes a base and monitor structured in combination (or a monitor structured to comprise a base) to securely encompass a wall rim, with fittings for attaching hose lines. Preferably and most simply a base for mounting on a wall rim is structured as a saddle, for encompassing and sitting on top of a rim of a wall. The rim could be a tank wall rim or a rim of any vertical wall, not necessarily a circular wall of a storage tank. The "wall" could be a pickup truck tailgate, a dozer blade or a cinderblock or concrete wall surrounding a flammable liquid storage area, depending upon the circumstances. The apparatus base would preferably be designed both for stability, weight and versatility, ideally being adjustable to fit as many different wall type structures as possible and to accommodate a variety of monitors. The apparatus, although designed to be portable, could also be left in place, in part or in whole, permanently.

The monitor can have attached a variety of nozzles, but preferably either an automatic nozzle, which targets a given authority and range of the fire fighting fluid by adjusting to target a discharge pressure, or a nozzle of the sort preset to target a given a volumetric flow rate, presuming a given discharge pressure.

Although the description herein appears to presume that the apparatus will be supplied by fire fighting fluid via hoses, such "hose" could in fact be a fixed pipe. The word hose as used herein is intended to encompass fixed pipes.

The fire fighting fluid is anticipated to be water or a water-foam concentrate solution that forms a foam upon application, as is known. The fluid could, of course, be any effective or desired fire fighting fluid.

One clear advantage of the instant portable wall-attachable monitor apparatus and method is minimizing the risk to firefighters fighting seal fires or sunken roofs with fire potential.

The instant apparatus is designed to apply a fire fighting fluid while allowing the firefighter to remain largely stationed remotely. In current practice firefighters are frequently called upon to walk the wind-gutters or the pan itself when tank seal fires or tank seal hazardous situations or sunken roofs are involved.

SUMMARY OF THE INVENTION

The present invention is directed to a portable wall-attachable monitor apparatus and its method of use. The apparatus includes a base structure, one or more fittings and a monitor. The apparatus is designed and structured in combination to attach to a wall rim portion. One or more fittings are provided to attach a hose to the apparatus.

Preferably a significant portion of the apparatus is constructed of aluminum in order to enhance its portability by firefighters during a fire. In particular, it would be desirable for the apparatus to be carried up the ladder on the side of a tank. Alternately, the apparatus could be lifted by a crane, were it too heavy. An extension stem may provide an auxiliary outlet for auxiliary firefighting apparatus, such as a localized wand.

By affixing the monitor and apparatus in place and adjusting the monitor to target an appropriate fire extinguishing area, the firefighter can retreat to a remote distance while fire extinguishing fluid is applied to the hazardous area minimizing unproductive loss of fluid to fall out.

The invention is also directed to a portable frame for providing a suitable wall rim portion to which the above apparatus may be attached. One portable frame structure is designed to be located on the ground. An alternate portable frame structure is designed to be bolted to the bed of a pickup truck.

BRIEF DESCRIPTION OF THE DRAWINGS

A better understanding of the present invention can be obtained when the following detailed description of the preferred embodiment is considered in conjunction with the following drawings, in which:

FIG. 2A presents a side view of apparatus similar to that in FIG. 1A but of larger size.

FIG. 2B presents an end view of the apparatus of FIG. 2A having monitor attached.

FIGS. 7A and 7B illustrate an alternate frame for providing a wall rim portion to which the monitor apparatus and base structure may be affixed, the frame of FIGS. 7A and 7B being suitable for locating on the ground.

DETAILED DESCRIPTION OF PREFERRED EMBODIMENTS

Figure 1A:
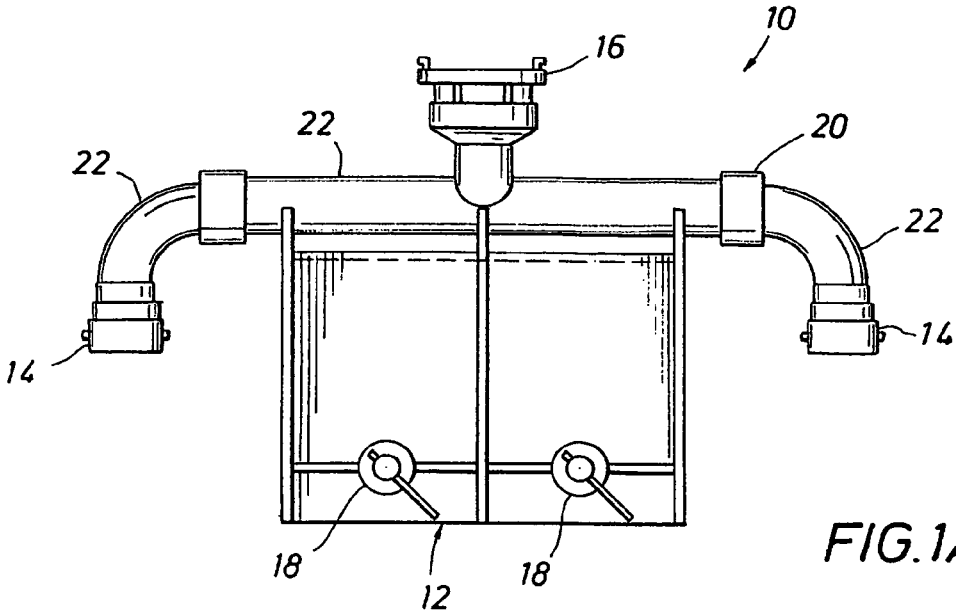
FIG. 1A presents a side illustrative view of a base portion of the apparatus applicable for attachment to a monitor and to hose.
Figure 1B:
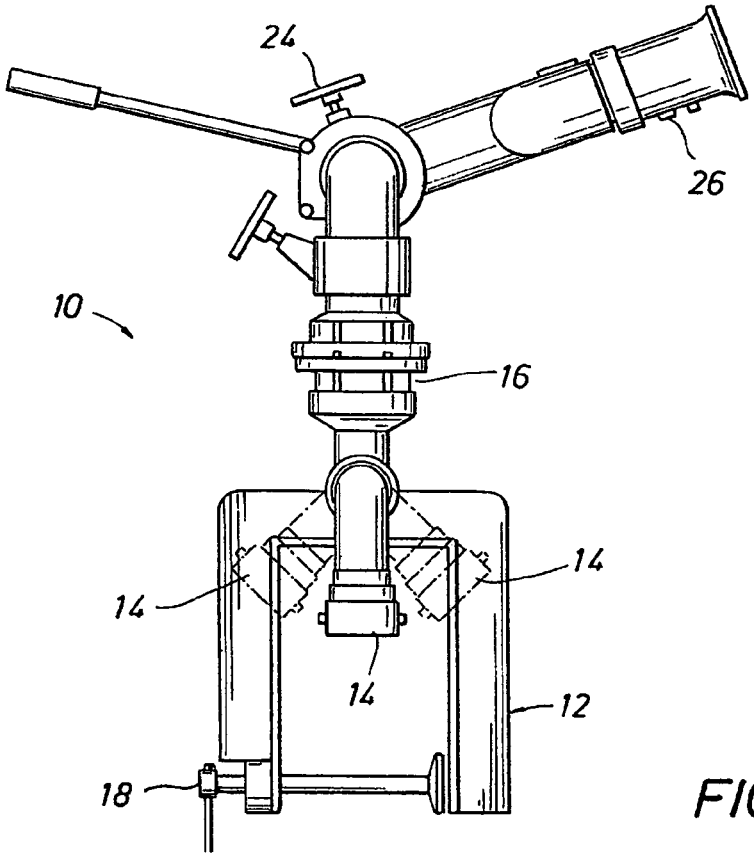
FIG. 1B presents an end view of the apparatus of FIG. 1A having a monitor attached.

FIG. 1A illustrates portions of a portable wall-attachable fire fighting apparatus. Apparatus 10 is illustrated in FIG. 1A without monitor 24 attached. FIG. 1B illustrates apparatus 10 with monitor 24 attached. Monitor 24 could be an integral part of the apparatus. Alternately, to enhance versatility, a base could be designed such that the base is attachable, such as by fitting 16, with a variety of monitors.

Referring to FIG. 1A, a base is preferably comprised of a saddle 12 of lightweight construction, such as aluminum. The benefit of lightweight construction is that it may enable a firefighter to carry the apparatus up the ladder of a tank. The saddle shape of base 12 is better illustrated by the end view of FIG. 1B. Base 12 is shown provided with one or more screw clamps 18. A variety of attachment means could be utilized. Screw clamp 18 permits a given base 12 to be attached to a variety of rim walls, from concrete block walls to tank walls to bulldozer blades and pickup truck tailgates.

Base 12 is shown fitted with pipe 22, preferably having swivel connections 20. Pipe 22 preferably ends in one or more hose connections 14. FIG. 1A shows an apparatus designed for a 2½" hose connection. The apparatus of FIGS. 1A and 1B can likely be made portable by firefighters up a ladder of a tank in an emergency. In FIGS. 1A and 1B a 5" monitor connection 16 is provided for mating with monitor 24. Again monitor 24 is preferably also constructed of aluminum in order to achieve a lightweight result. Monitor 24 is shown with a 3" waterway. Nozzle 26 is connected to the outlet end of monitor 24.

Means are provided on a monitor, as is known in the art, to adjust the monitor in azimuth and inclination.

FIGS. 2A and 2B illustrate a larger version of the portable wall attachable fire fighting apparatus. In FIGS. 2A and 2B only one fitting 14 is provided for connection with a hose. FIGS. 2A and 2B illustrate the placement of lifting eye 13 to permit the portable wall-attachable fire fighting apparatus to be lifted into place by a crane. Monitor 24 is shown providing a 4" waterway with a dual hand-wheel and a 3½" outlet. The apparatus is shown having a 4" flanged monitor connection 16. Provision is made for a 5" hose connection 14.

Figure 3:
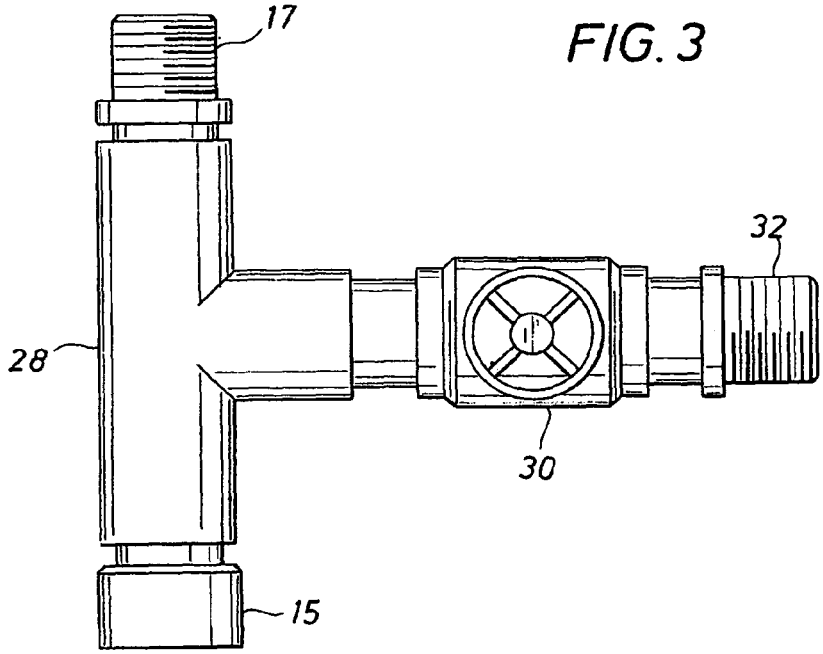
FIG. 3 illustrates a stern attachment providing an auxiliary discharge for the apparatus.

FIG. 3 illustrates a connecting piece 28 that provides an enhancement for the portable wall-attachable fire fighting apparatus. Stem 28 would screw into hose fitting 14 and provide a fitting 15 for connection to a hose. Stem 28 provides valve 30 and auxiliary discharge port 32. The value of stem 28 is to be able to siphon fluid off from the hose prior to delivery to the monitor outlet in order to use the fluid for an auxiliary discharge unit.

Figure 4:
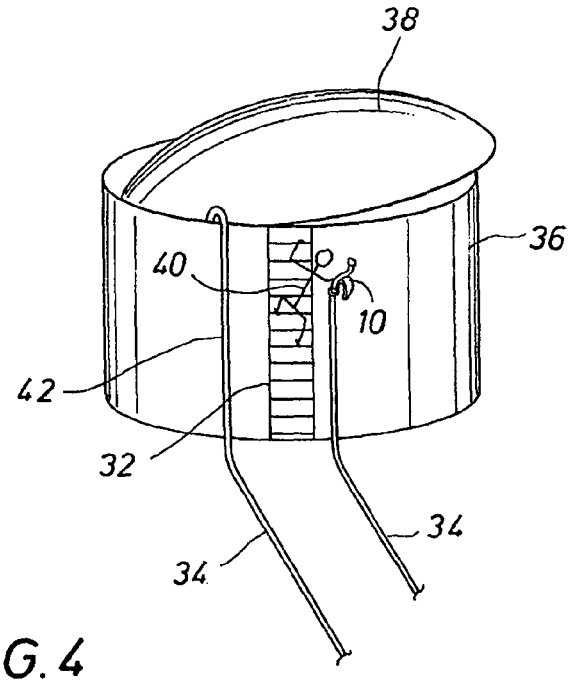
FIG. 4 illustrates a methodology using the present invention.

FIG. 4 illustrates portions of the methodology of the present invention. Firefighter 40 is illustrated climbing ladder 32 on the side of tank 36 having a sunken or dislodged roof 38. Firefighter 40 is shown carrying apparatus 10 to the top of the tank wall where it will be set in place. Wand 40 is shown in place connected to hose 34 in order to distribute foam at least over the area immediately below and on both sides of the ladder in the tank for the protection of firefighter 40. Apparatus 10 is connected to hose 34. If apparatus 10 contains an auxiliary discharge port the firefighter may not only adjust the monitor to appropriately target a mainstream of fluid but the firefighter may also attach discharge apparatus to the auxiliary port in order to target secondary areas.

Figure 5A:
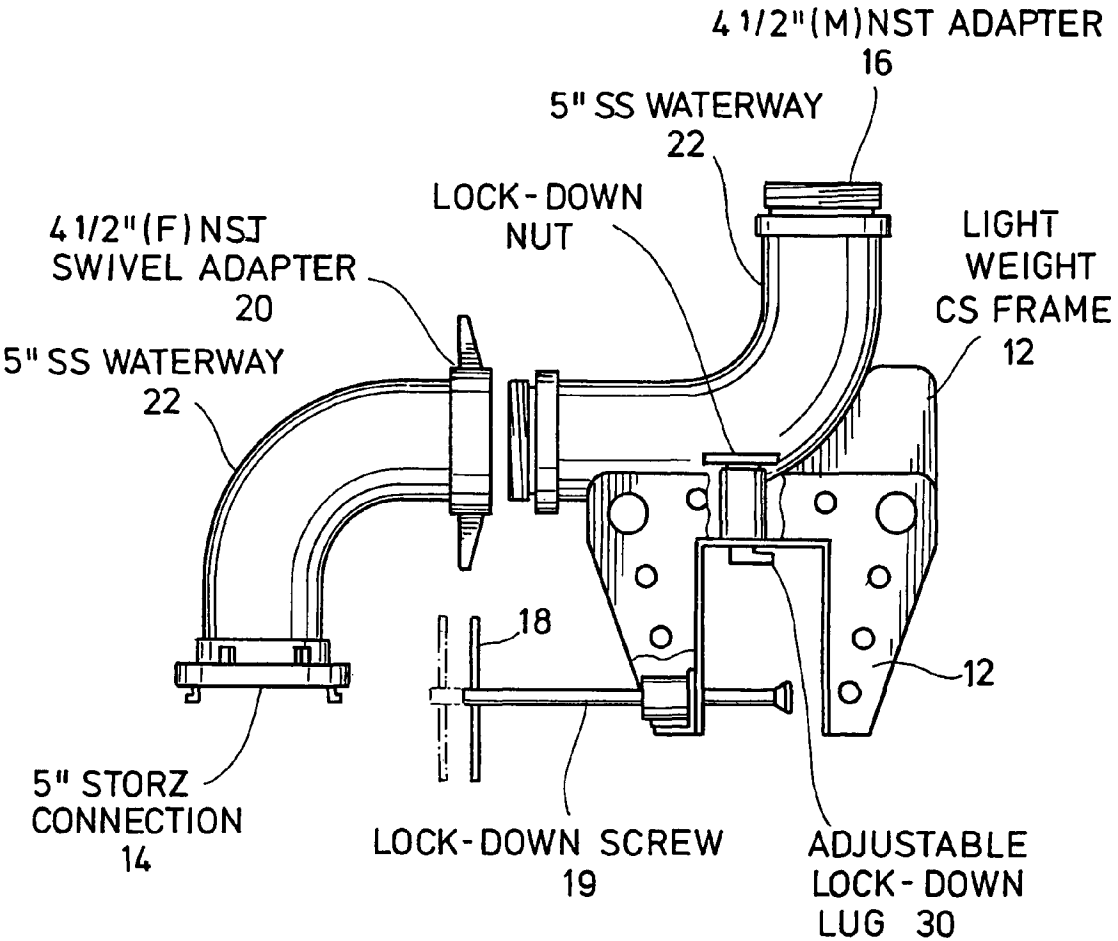
FIGS. 5A and 5B present side and end views similar to FIGS. 2A and 2B, also illustrating an adjustable lockdown lug.
Figure 5B:
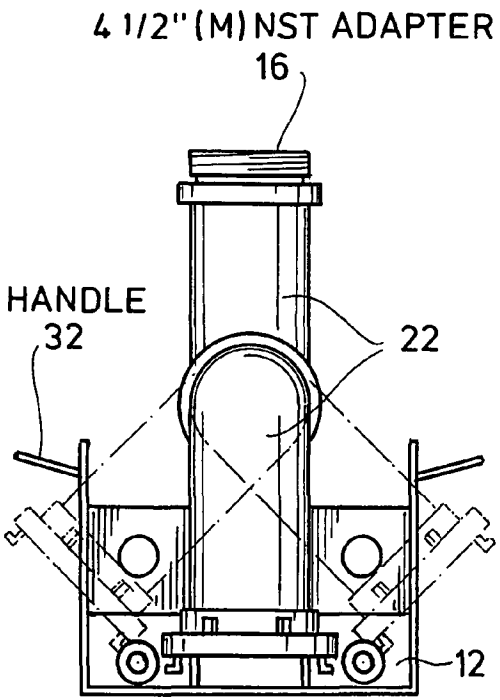

FIGS. 5A and 5B are similar to FIGS. 2A and 2B, discussed above. FIG. 5A, in particular, illustrates an adjustable lockdown lug 30, useful for affixing the portable wall attachable fire fighting apparatus to a wall rim portion provided by portable frame. As can be seen in FIGS. 6A, 6B, 7A and 7B, lug 30 locks around an angle element 46 or 56, affixed to the wall rim provided by the portable frame.

Figure 6B:
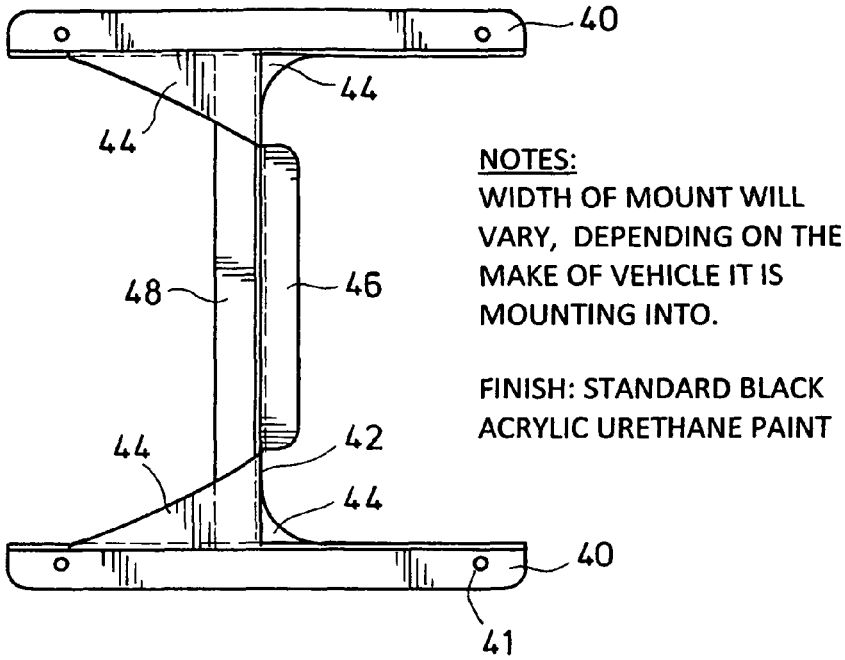
FIGS. 6A and 6B illustrate a portable frame to provide a suitable wall rim portion to which the monitor apparatus and base structure may be affixed, the frame particularly suitable for bolting to a pickup truck bed.
Figure 6A:
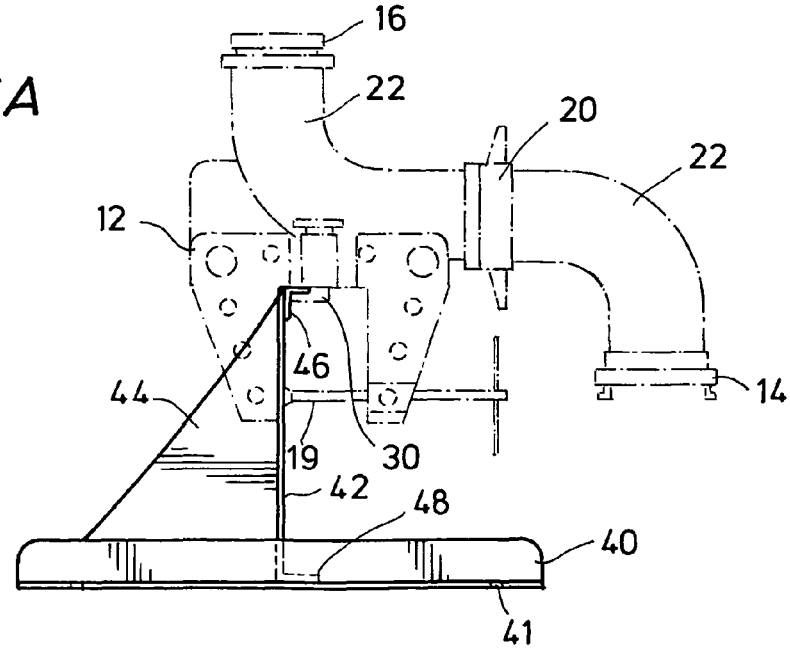

FIGS. 6A and 6B and 7A and 7B illustrate two embodiments of a portable frame that can be used to provide a wall rim portion to which the portable wall attachable fire fighting apparatus can be attached. The frame of FIGS. 6A and 6B is particularly adapted for being bolted to a pickup truck bed. Frame element 40 comprises pieces of angle iron having bolt holes 41 for becoming affixed to a pickup truck bed. Transverse angle iron element 48 attaches to and between side angle iron elements 40. Vertical plate 42 is affixed between side angle iron frame elements 40. Vertical plate 42 provides the wall rim portion to which the fire fighting apparatus may be attached. Webbing 44 is designed to hold wall element 42 securely in place with respect to frame elements 40 and 48. Preferably, the upper rim of vertical wall portion 42 is firmly secured to an angle rim element 46. Adjustable lockdown lug 30 is designed to lock over a portion of angle iron element 46, helping to further secure the portable fire fighting apparatus to the portable frame. Lockdown screw 19 adjustably attaches the fire fighting apparatus to wall portion 42 provided by the portable frame.

The frame illustrated in FIGS. 7A and 7B is intended to be installed or located upon the ground. Leg strap hose receivers 53 are provided attached to frame legs 50. Leg receivers 53 receive hose to help provide ballast for the frame on the ground. Preferably legs 50 of the frame of FIGS. 7A and 7B would be removable for ease in handling. As in FIGS. 6A and 6B, the frame of FIGS. 7A and 7B provides wall 58 which provides a wall rim portion for attaching the portable fire fighting apparatus. As in FIGS. 6A and 6B, the top of vertical wall 58 is preferably affixed to an angle iron element 56 to help provide a secure attachment for the portable fire fighting apparatus.

In the following claims, when a base and/or a monitor are referred to, it should be understood that one or more bases and one or more monitors could be used. Although the invention can be practiced with one base and one monitor, multiple bases and/or multiple monitors would not change the nature of the invention.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumption that recitation of a single element covers one or more, and recitation of two elements covers two or more, and the like.

What is claimed is:

1. Portable wall-attachable monitor apparatus, comprising:

a base structure, a nozzle and a monitor attached between the nozzle and the base structure, the monitor providing at least one degree of freedom for the nozzle with respect to the base structure;

the apparatus structured in combination to surround, and to adjustably yet fixedly attach to, a wall rim portion and having one or more fittings for attaching a hose to the apparatus;

the monitor providing a positive angle of inclination above the horizon for the nozzle when the apparatus is oriented for attachment to the wall rim portion; and wherein the base structure includes at least one adjustable pressure fit element structured to fixedly secure the base element to a wall rim portion.

2. The apparatus of claim 1 wherein an automatic pressure regulating nozzle is attached to the monitor.

3. The apparatus of claim 1 wherein at least a significant portion is constructed of aluminum.

4. The apparatus of claim 1 wherein the base structure includes a saddle for surrounding a wall rim portion.

5. The apparatus of claim 1 wherein the monitor provides at least two degrees of freedom for the nozzle with respect to the base structure.

6. The apparatus of claim 1 wherein a base of the apparatus is structured in combination to adjustably, yet fixably, attach to a wall rim portion so as to provide stable operations under at least 100 psi supplied fluid pressure to the monitor while maintaining a positive angle of inclination above the horizon.

7. The apparatus of claim 6 wherein the monitor provides at least a three-inch diameter waterway and at least two degrees of freedom for the nozzle including a positive angle of inclination above the horizon.

8. A method for fighting tank fires, comprising:

adjustably yet fixedly affixing to and over a rim portion of a tank wall a portable monitor apparatus having a nozzle attached;

attaching a hose to a fitting of the apparatus; and adjusting at least one degree of freedom of the monitor to direct the nozzle toward an appropriate fire extinguishment target with a positive angle of inclination above the horizon when the apparatus is oriented for attachment to the tank wall portion; and wherein affixing includes affixing by fitting a saddle to a rim portion of a wall using an adjustable pressure fit element.

9. The method of claim 8 that includes attaching additional fire fighting apparatus to an auxiliary outlet of the portable apparatus and diverting fire fighting fluid from a monitor nozzle.

10. The method of claim 8 that includes positioning a wand over a tank wall proximate the position of the portable apparatus.

11. The method of claim 8 that includes attaching an automatic pressure regulating nozzle to the monitor.

12. The method of claim 8 that includes adjusting at least two degrees of freedom of the monitor.

13. The method of claim 8 that includes utilizing a portable frame to provide a rim portion of a wall.

14. The method of claim 13 that includes affixing the portable frame to the bed of a pickup truck.

15. The method of claim 13 that includes locating the portable frame on the ground.

16. The method of claim 8 including affixing during a fire or hazard.

17. The method of claim 8 that includes adjustably, yet fixably, attaching a base of the monitor for stably applying fire fighting fluid through the monitor and nozzle under up to at least 100 psi supplied fluid pressure while maintaining a positive angle of inclination above the horizon.

18. The method of claim 8 or 17 that includes the monitor providing at least a three-inch diameter waterway and at least two degrees of freedom for the nozzle including a positive angle inclination above the horizon.

19. Portable wall-attachable monitor apparatus, comprising:

a base structure, a nozzle and a monitor attached between the nozzle and the base structure, the monitor providing at least one degree of freedom for the nozzle with respect to the base structure;

the apparatus structured in combination to surround, and to adjustably yet fixedly attach to, a wall rim portion and having one or more fittings for attaching a hose to the apparatus;

the monitor providing a positive angle of inclination above the horizon for the nozzle when the apparatus is oriented for attachment to the wall rim portion; and wherein the base structure includes at least one adjustable pressure fit element structured to fixedly secure the base element to a wall rim portion; and the apparatus of claim 1 that includes means for releasable attachment of the base structure to the wall rim portion.

20. The apparatus of claim 19 wherein the means for releasable attachment of the base structure to the wall rim portions includes an adjustable lock-down lug.

21. Portable wall attachable monitor apparatus and wall rim portion in combination, comprising:

a base structure, a nozzle and a monitor attached between the nozzle and the base structure, the monitor providing at least one degree of freedom for the nozzle with respect to the base structure;

a portable wall rim portion; and the apparatus structured in combination to adjustably yet fixedly attach to and over the wall rim portion and having one or more fittings for attaching a hose to the apparatus;

the monitor providing a positive angle of inclination above the horizon for the nozzle when the apparatus is oriented for attachment to the wall rim portion.

22. The apparatus of claim 21 wherein the wall rim portion is provided by a portable frame.

23. The apparatus of claim 22 wherein the portable frame is adapted to be attached to a pickup truck bed.

24. The apparatus of claim 22 wherein the portable frame is adapted to rest on the ground.

* * * * *